US009121077B2

(12) United States Patent
Penney

(10) Patent No.: US 9,121,077 B2
(45) Date of Patent: Sep. 1, 2015

(54) TUYERE REMOVER

(75) Inventor: James Douglas Penney, Port Dover (CA)

(73) Assignee: Tube City IMS Corporation, Glassport, PA (US)

( * ) Notice: Subject to any disclaimer, the term of this patent is extended or adjusted under 35 U.S.C. 154(b) by 0 days.

(21) Appl. No.: 13/530,376

(22) Filed: Jun. 22, 2012

(65) Prior Publication Data

US 2013/0161882 A1 Jun. 27, 2013

Related U.S. Application Data

(60) Provisional application No. 61/499,874, filed on Jun. 22, 2011.

(51) Int. Cl.
*C21B 7/16* (2006.01)

(52) U.S. Cl.
CPC ..... *C21B 7/166* (2013.01)

(58) Field of Classification Search
CPC ..... C21B 7/166
USPC ..... 266/271, 287, 265
See application file for complete search history.

(56) References Cited

U.S. PATENT DOCUMENTS

| | | | | |
|---|---|---|---|---|
| 3,458,918 | A * | 8/1969 | Kitajima et al. | 29/239 |
| 4,087,084 | A * | 5/1978 | Meyers | 266/287 |
| 5,127,633 | A * | 7/1992 | Mailliet | 266/271 |
| 2013/0161882 | A1 * | 6/2013 | Penney | 266/287 |

FOREIGN PATENT DOCUMENTS

DE 3017804 A * 11/1981

* cited by examiner

*Primary Examiner* — Scott Kastler
(74) *Attorney, Agent, or Firm* — Paul D. Bangor, Jr.; Clark Hill PLC

(57) ABSTRACT

A component of a gas injection system (tuyere/tymp) removal apparatus comprising a pneumatic or hydraulic hammer reverse mounted into a hammer frame, the working end of the hammer fixedly attached a first end of a slidable frame. The slidable frame having a second end fixedly attached to an elongated lifting arm means with a component handling means, and two sides slidably attached to the hammer frame. The component handling means may be inserted into the rear of a component of a gas injection system. When activated, the hammer generates a pulling motion on the component handling means engaged with the component of a gas injection system, releasing the component of a gas injection system from the wall of the blast furnace.

7 Claims, 2 Drawing Sheets

TUYERE REMOVER

CROSS REFERENCE TO RELATED APPLICATIONS

The present application claims benefit and priority from U.S. provisional application Ser. No. 61/499,874 entitled "TUYERE REMOVER", filed Jun. 22, 2011, the disclosure of which is hereby incorporated by reference herein in its entirety for all purposes.

TECHNICAL FIELD OF THE INVENTION

The present invention relates in general to removal devices for components of a gas injection system, and has more particular reference to removal of a tuyere from blast furnace walls by aid of a reverse mounted hydraulic or pneumatic hammer to provide a pulling motion on the tuyere.

BACKGROUND-FIELD OF THE DISCLOSURE

Steel makers are increasingly shaped by the forces of globalization. Increasingly, steel companies are turning to maintenance and service companies to help them develop solutions that will reduce furnace downtimes, reduce costs and improve on mill safety. Many of their maintenance systems are manual, time consuming and have an unacceptably high operator injury rate. Improved maintenance techniques and equipment can improve efficiency and advance technology.

A tuyere is a nozzle through which air and other gases are blown into a blast furnace via a blow pipe under pressure from a blast engine or other device. Injection through the tuyere creates furnace temperatures far higher than could be normally achieved. A modern blast furnace contains 24 to 36 tuyeres. Tuyeres are constructed from pure copper and cooled with internal water pipes to withstand the extreme temperatures. A typical tuyere measures 18 in. in end diameter on the intake end, 6¼in. to 7¾in. diameter at the nose end and are approximately 21 in. in length. They are very heavy and pressed hydraulically into a cooler inserted in a tymp (hollow water-cooled iron cushing) in the furnace wall to a pressure of 5000 lb. The noses can be heavily damaged by the furnace environment and removing a heavy, damaged tuyere press-fit into the cooler is no small task, especially for a manual system.

Compounding the challenge is the demanding environment of the tuyeres and the often limited space in which to access the tuyeres for installation and maintenance The life of a tuyere varies (from several days to several months) and can breakdown by burning and deformation of the tuyere walls caused by materials, such as skull, in the furnace environment. The loss can often be catastrophic in the case of water leakage which results in molten iron and gases escaping the pressurized furnace. A ten minute break out can result in a multimillion dollar loss and days of furnace down time. The replacement of one single tuyere without a break out typically interrupts the operation of the furnace for one hour or more, depending on the length of time the tuyere has been in the furnace and the amount of damage, at a downtime cost of several thousand of dollars per minute.

Lin, et al., U.S. Pat. No. 5,925,312, describe a device for removing tuyeres. The device utilizes a hydraulic cylinder attached to a rod having an attached hook. The device is moved into position in line with the tuyere, the hook engaged, and the hydraulic cylinder is activated to pull the tuyere from its tymp.

A hydraulic cylinder or ram is also employed in U.S. Pat. No. 4,087,084, to Meyers, to aid in the loosening of the tuyere from its tymp. But here, a hydraulic hammer, placed on a parallel axis with the rod, supplies vibration to the rod to aid in loosening the tuyere. The tuyere is then removed by action of the hydraulic cylinder. The hydraulic hammer provides vibration, but does not utilize the force of the hammer to pull the tuyere.

Malliet describes tuyere removal devices and movable supports to utilize the device. U.S. Pat. No. 5,127,633 describes the device with an air percussion hammer mounted co-axial with a double-piston ram and cylindrical rod mounted therein. The rod has a notch or hook at the end gripped by the ram. Malleit, in U.S. Pat. No. 4,266,907, mounts the device onto a self-propelled vehicle. The co-axial arrangement of the hammer and rod provides a reciprocating impact onto the tuyere, but the energy provided by the air percussion hammer is in a forward, pushing direction instead of the desired pulling direction.

Other existing tuyere removal methods may be entirely manual process and involve multiple operators manoeuvring a charge cart with a counterweighted component handling means and rope system to haul the tuyere out of the furnace wall. This method often takes several attempts and injury to operators is not uncommon. More automated systems for tuyere removal utilize hydraulic cylinders to pull the tuyere, but attached hammers are used either to vibrate the removal tool or push the tuyere.

A need for a removal device and method that quickly and easily pulls the tuyere from its tymp, reducing downtime, as well as preventing operator injuries, is desired.

SUMMARY OF THE INVENTION

Hammer means are reverse mounted into a hammer frame. The working end of the hammer is fixedly attached to a slidable frame. The slidable frame is slidably attached to the sides of the hammer frame. The slidable frame is fixedly attached it to an elongated lifting arm means with a component handling means at the end. The component handling means is engaged in the back side of a tuyere.

The hammer frame may be attached to the boom of a small excavator. As the hammer is activated by an operator of the excavator, the slidable frame moves relative to the hammer frame and the excavator, applying energy into a pulling motion on the elongated lifting arm means and component handling means and, concomitantly, the tuyere.

Using the apparatus with the reverse hammer design, tuyere removal time was reduced from 1 hour to a few minutes. Over 24 tuyeres, this represents a significant reduction in downtime costs. The system is much safer than other designs as only the excavator operator is involved in the removal after the blow pipe and other equipment were disconnected.

In a preferred embodiment, the present invention combines the use of a reverse mounted hammer fixedly attached by means of a slidable frame to a elongated lifting arm means with a component handling means for pulling on a tuyere, generating the force needed to remove a tuyere from a blast furnace wall. These and other advantages of the invention will be appreciated by reference to the detailed description of the preferred embodiment(s) that follow.

DETAILED DESCRIPTION OF PREFERRED EMBODIMENT(S) OF THE INVENTION

In the following detailed description, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed. The following description is, therefore, not to be taken in a limited sense, and the scope of the inventive subject matter is defined by the appended claims and their equivalents.

Figure 1:
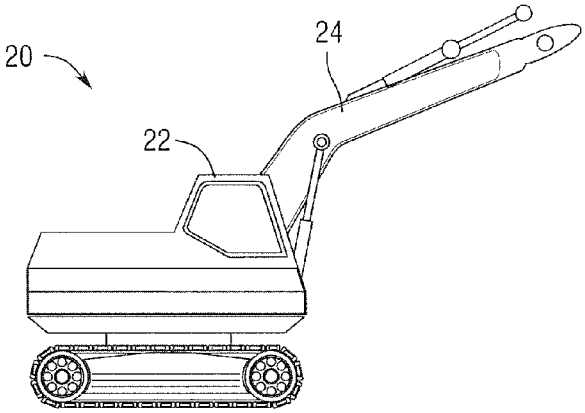
FIG. 1: Side view of an Excavator with boom, stick, and bucket.
Figure 2:
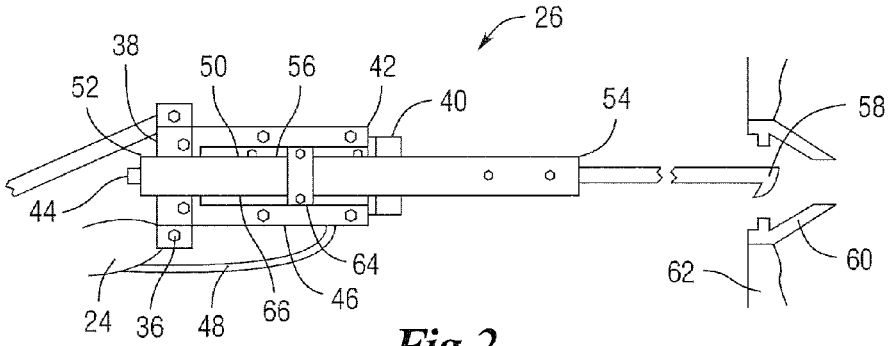
FIG. 2: Side view of Excavator Arm, Hammer Frame, Sliding Frame, Elongated lifting arm means, Component handling means, and Tuyere.

FIGS. 1 & 2 show a preferred embodiment of a tuyere removing apparatus 10 according to the present invention comprising a tractor or other motorized vehicle 20 with an operator cab 22, a boom 24, and a tuyere removing attachment 26. Preferably, in the tuyere removing apparatus 10, the boom 24 lays flatter to reduce the boom's working height and allows the center of gravity of the tuyere remover apparatus 10 to be closer to the cab 22 to compensate for the weight of a tuyere when carried by tuyere removing apparatus 10 on removal.

Referring to FIG. 2, a preferred embodiment of the tuyere remover 10 of the present invention comprises hammer 40, hammer frame 46 and one-piece sliding frame 50. The end 36 of boom 24 may be pivotally attached to a hammer frame 46 having a first end 38 of a hammer frame 46. A hammer 40 is fixed by attachment means to the second end of the hammer frame 42 so that the longitudinal axis of the hammer 40 is co-linear with the longitudinal axis of the hammer frame 46. Preferably, the hammer working end 44 is nearer the first end 38 of the hammer frame 46, thus in a reversed hammer configuration. The attachment means may be bolts, welding or any other means to temporarily or permanently prevent movement between the hammer 40 and the hammer frame 46. The hammer 40 may be controlled by hydraulic or pneumatic means 48.

The hammer working end 44 is attached to a sliding frame 50 at a sliding frame first end 52. The sliding frame 50 is of a general rectangular shape with the first end 52, a second end 54, and two sides 56 connecting the sliding frame first end 52 and second end 54. The sliding frame 50 defines an opening of sufficient length and width to accommodate the hammer frame 46. The sliding frame 50 is slidably attached by sliding means 66 to the hammer frame 46 such that when the hammer 40 is activated by hydraulic or pneumatic means, the sliding frame 50 moves in conjunction with the hammer working end 44 and moves relative to the hammer frame 42. The sliding means 66 may comprise brackets 64. The sliding frame second end 54 may be attached to one end an elongated lifting arm means 56 having a component handling means 58 at the other end. The component handling means 58 is designed to fit into the inside of a tuyere 60 which is mounted in the wall of the blast furnace 62. The component handling means 58 is preferably a hook which preferably engages or hooks onto a rim 63 on the inside of tuyere 60. The overall length of the device from the first end 38 of the hammer frame 46 to the component handling means 58 is preferably about 7 feet.

The hammer 40 preferably is designed to deliver a maximum of 200-400 J per blow. More preferably, the hammer 40 is designed to deliver 400 J per blow. As the hammer 40 is reverse mounted, the energy of impact is sharply directed to a pulling motion on the inside of the tuyere 60.

Figure 3:
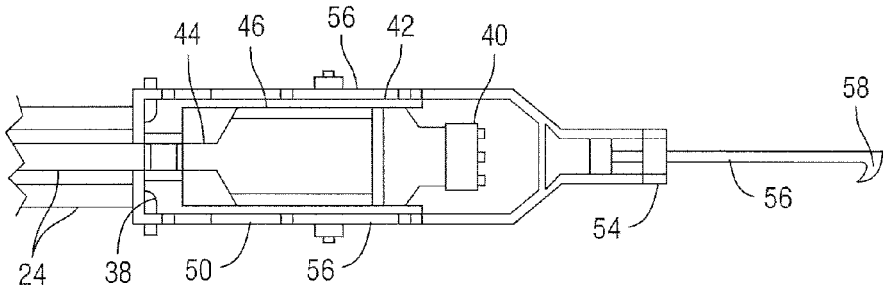
FIG. 3: Top view of Side Plate Hammer, Sliding Frame, Elongated lifting arm means, and Component handling means.

FIG. 3 shows the top view of the tuyere remover 10 of the present invention. The hammer 40 is reverse attached to the second end 42 of hammer frame 46 such that the hammer working end 44 is proximal to the boom 24. The sliding frame 50 is attached to the hammer working end 44. The sliding frame sides 56 are slidably attached to the outside of the hammer frame 46. The elongated lifting arm means 58 is attached to the second end 54 of the sliding frame 50.

Figure 4:
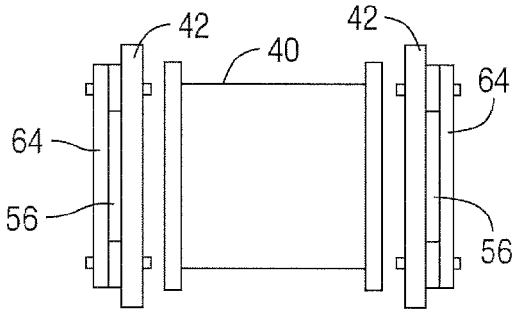
FIG. 4: Cross view of Side Plate Hammer, Sliding Frame, Elongated lifting arm means perpendicular to the axis of the hammer means.

FIG. 4 shows the cross view of the tuyere remover 10 midway and perpendicular to the axis of the hammer means 40. The sliding frame sides 56 are mounted within brackets 64 affixed to the hammer frame 46.

Figure 5:
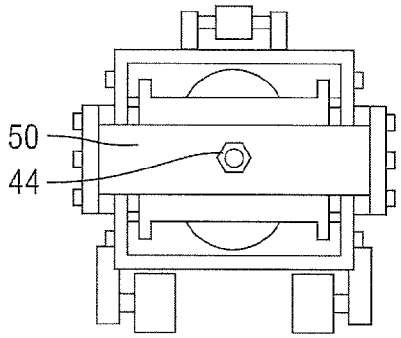
FIG. 5: Rear view of Side Plate Hammer and Sliding Frame.
Figure 6:
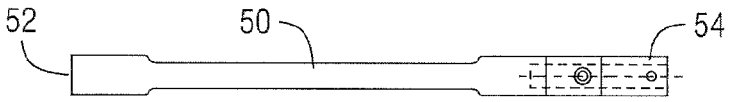
FIG. 6: Side elevational view of a preferred one-piece Sliding Frame of the present invention.
Figure 7:
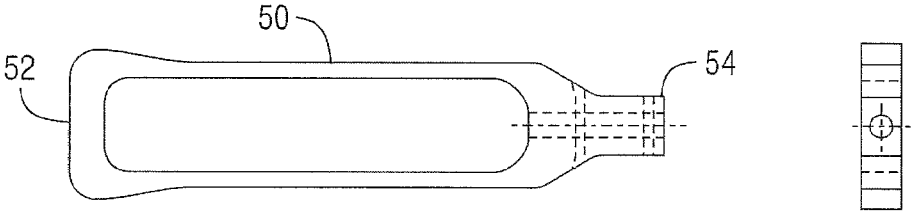
FIG. 7: Top plan view of a preferred one-piece Sliding Frame of the present invention.

FIG. 5 shows a rear view of the tuyere remover showing the attachment of the sliding frame 50 to the hammer working end 44.

During use, an operator in the cab 22 moves the apparatus into position such that the component handling means 58 engages a tuyere 60 to be removed. The hammer 40 is then activated by hydraulic or pneumatic means 48. The hammer working end 44 moves out and in. The sliding frame 50 attached to the hammer working end 44 moves in conjunction with the hammer working end 44, and slidably with respect to the hammer frame 46. The elongated lifting arm means 58 attached to the sliding frame moves in conjunction with the sliding frame and hammer working end 44. The component handling means 58 vibrates on the tuyere with each movement of the hammer working end 44. When the tuyere 60 is loose, it is pulled from the blast furnace wall 62 by the tuyere removing device 10, generally by backing up device to with the tuyere 10 thereon and carried away on the component handling means 58.

In the foregoing Detailed Description, various features may be grouped together in a single embodiment to streamline the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

I claim:

1. An apparatus mountable on a self-propelled vehicle for handling, installing and/or removing a tuyere or tymp from a shaft furnace, consisting essentially of:

a movable frame having first and second ends and an engagement component mounted on the second end of the movable frame for engaging the tuyere or tymp; wherein the movable frame consists essentially of a one-piece construction and is mounted on a second frame so that the movable frame can move in at least first and second directions;

a hammer mounted on the second frame wherein a longitudinal axis of the hammer is co-linear with a longitudinal axis of the second frame and wherein a working end of the hammer acts against the movable frame to move the movable frame in a first direction.

2. The apparatus of claim 1 wherein the hammer consists essentially of a hydraulic-powered hammer.

3. The apparatus of claim 1 wherein the hammer consists essentially of a pneumatic-powered hammer.

4. The apparatus of claim 1 wherein the hammer consists essentially of a power hammer.

5. The apparatus of claim 1 wherein the hammer consists essentially of an electric-powered hammer.

6. The apparatus of claim 1 wherein the engagement component is a hook.

7. The apparatus of claim 1 wherein the engagement component is integral with the movable frame.

* * * * *

UNITED STATES PATENT AND TRADEMARK OFFICE

CERTIFICATE OF CORRECTION

PATENT NO. : 9,121,077 B2
APPLICATION NO. : 13/530376
DATED : September 1, 2015
INVENTOR(S) : James Douglas Penney It is certified that error appears in the above-identified patent and that said Letters Patent is hereby corrected as shown below:

Specification

Column 1, line 39, delete "6¾in. to 7¾in." and insert -- 6¾ in. to 7¾ in. --.

Column 1, line 49, after "maintenance" insert -- . --.

Signed and Sealed this
Twenty-first Day of June, 2016

Michelle K. Lee

Michelle K. Lee
*Director of the United States Patent and Trademark Office*